US006812628B2

(12) United States Patent
Bucher

(10) Patent No.: US 6,812,628 B2
(45) Date of Patent: Nov. 2, 2004

(54) BRACKET FOR MOUNTING A SHADOW MASK FRAME

(75) Inventor: Alan Weir Bucher, Manheim, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 290 days.

(21) Appl. No.: 10/143,089

(22) Filed: May 9, 2002

(65) Prior Publication Data

US 2003/0209965 A1 Nov. 13, 2003

(51) Int. Cl.[7] ..... H01J 29/80
(52) U.S. Cl. ..... 313/404; 313/402; 313/407
(58) Field of Search ..... 313/402, 404, 313/405, 406, 407

(56) References Cited

U.S. PATENT DOCUMENTS

| | | | | |
|---|---|---|---|---|
| 3,935,496 A | * | 1/1976 | Gijrath | 313/402 |
| 3,943,399 A | * | 3/1976 | Sedivy | 313/404 |
| 3,962,598 A | | 6/1976 | Schneider, Jr. | 313/406 |
| 4,994,712 A | | 2/1991 | Strauss | 313/405 |
| 5,023,507 A | | 6/1991 | Dougherty et al. | 313/407 |
| 5,557,162 A | | 9/1996 | Han | 313/402 |
| 5,644,192 A | | 7/1997 | Ragland, Jr. | 313/402 |

FOREIGN PATENT DOCUMENTS

| | | | |
|---|---|---|---|
| EP | 0488527 A1 | 10/1991 | H01J/29/07 |
| EP | 1069592 A2 | 1/2001 | H01J/29/07 |
| EP | 1271601 A2 | 1/2003 | H01J/29/07 |
| WO | WO 02/058098 | 7/2002 | |

* cited by examiner

*Primary Examiner*—Vip Patel
(74) *Attorney, Agent, or Firm*—Joseph S. Tripoli; Joseph J. Laks; Carlos M. Herrera

(57) ABSTRACT

A cathode ray tube includes an evacuated envelope having a substantially rectangular faceplate panel with two diagonal axes that extend between the opposing corners of the panel. The panel includes a mask-frame assembly having a frame with two opposing long sides and two opposing short sides forming a continuous mask support frame. The frame is mounted within the tube by brackets located near the corners of the frame. Each bracket is adjustably secured along the short sides of the frame and includes a flat surface section extending normal to the diagonal axes of the panel. A spring clip assembly is secured to the flat surface section of the bracket for engaging a stud affixed to the panel.

8 Claims, 2 Drawing Sheets

BRACKET FOR MOUNTING A SHADOW MASK FRAME

FIELD OF THE INVENTION

This invention relates to cathode ray tubes (CRTs) of the type having a shadow mask attached to a frame mounted within the tube and, more particularly, to a bracket for suspending a mask-frame assembly at the corners of a faceplate panel in such a CRT.

BACKGROUND OF THE INVENTION

A color cathode ray tube (CRT), has an electron gun for forming and directing three electron beams to a luminescent screen located on a glass faceplate panel. A shadow mask, which may be either a formed mask or a tension mask having strands, is located between the electron gun and the screen. The electron beams emitted from the electron gun pass through apertures in the shadow mask and strike the screen causing the phosphor elements to emit light so that an image is displayed on the viewing surface of the faceplate panel.

CRTs typically have mask frame assemblies comprising a steel frame to support the shadow mask within the faceplate panel of the tube. This frame provides a surface for attachment of a clip that is welded to the exterior surface of the frame typically near the corners. A spring extends from the clip, making a spring-clip assembly, having mounting features for mounting the frame to studs extending inward from the faceplate panel. The surface for the attachment of the spring-clip assembly is usually integrally formed into the frame. Because some tension mask frames are not stamped and formed, however, conventional methods of providing a surface for spring clip attachment are not readily applicable. As a result, a corner bracket is made separately and is later welded to the frame to create the spring-clip mounting surface.

Maintaining the dimensional control of the frame during frame fabrication has been problematic. Further, maintaining the dimensional integrity of the frame during the attachment of the bracket has likewise have been difficult. The dimensional inaccuracies of the frame effect the ability to properly position the spring-clip assembly for attachment. It is therefore desirable to develop a bracket for mounting a spring-clip assembly that can be secured to the side of the frame to ensure proper spring-to-stud spacing and spring fit. Further, it is desirable to develop a versatile bracket design that would simplify the welding and decrease material usage and that can be adapted to accommodate variations in frame width anticipated by manufacturing processes of the mask-frame assembly.

SUMMARY OF THE INVENTION

This invention relates to a cathode ray tube including an evacuated envelope having a substantially rectangular faceplate panel having two diagonal axes that extend between the opposing corners of the panel. The panel includes a shadow mask-frame assembly having a frame with two opposing long sides and two opposing short sides forming a continuous mask support frame and is mounted within the tube by brackets located near the corners of the frame. Each bracket is adjustably secured along the short sides of the frame and includes a flat surface section extending normal to the diagonal axis of the panel. A spring-clip assembly is secured to the flat surface of the bracket for engaging a stud affixed to the panel.

BRIEF DESCRIPTION OF THE DRAWINGS

The invention will now be described by way of example with reference to the accompanying figures.

DETAILED DESCRIPTION OF THE PREFERRED EMBODIMENTS

Figure 1:
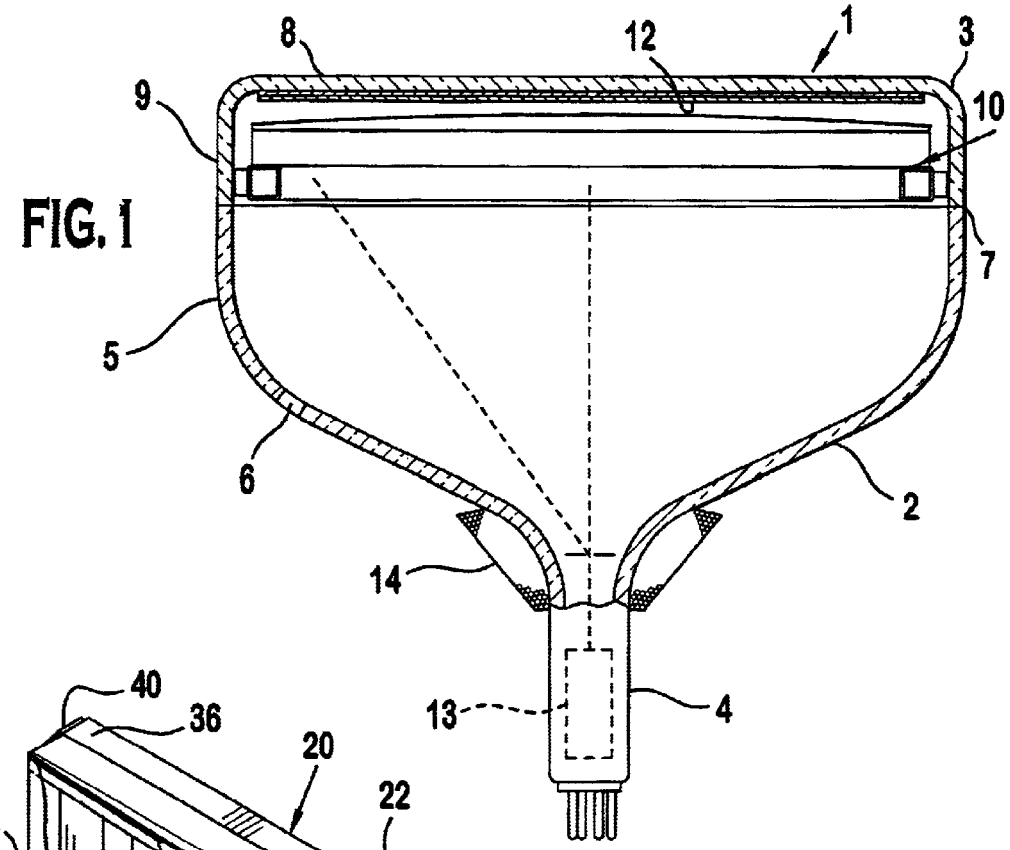
FIG. 1 is a cross-sectional top view of a CRT.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 has a viewing faceplate 8 and a peripheral flange or sidewall 9, which is sealed to the funnel 5 by a glass frit 7. A luminescent screen 12 is carried by the inner surface of the faceplate panel 3. A shadow mask frame assembly 10 is removably mounted in predetermined spaced relation to the screen 12. An electron gun 13 (shown schematically by dashed lines in FIG. 1) is centrally mounted within the neck 4 to generate and direct three inline electron beams, a center beam and two side or outer beams, along convergent paths through the mask-frame assembly 10 to the screen 12. The CRT 1 of FIG. 1 is designed to be used with an external magnetic deflection yoke 14 located in the vicinity of the funnel-to-neck junction. When activated, the yoke 14 subjects the three electron beams to magnetic fields which cause the beams to scan horizontally and vertically in a rectangular raster over the screen 12.

Figure 2:
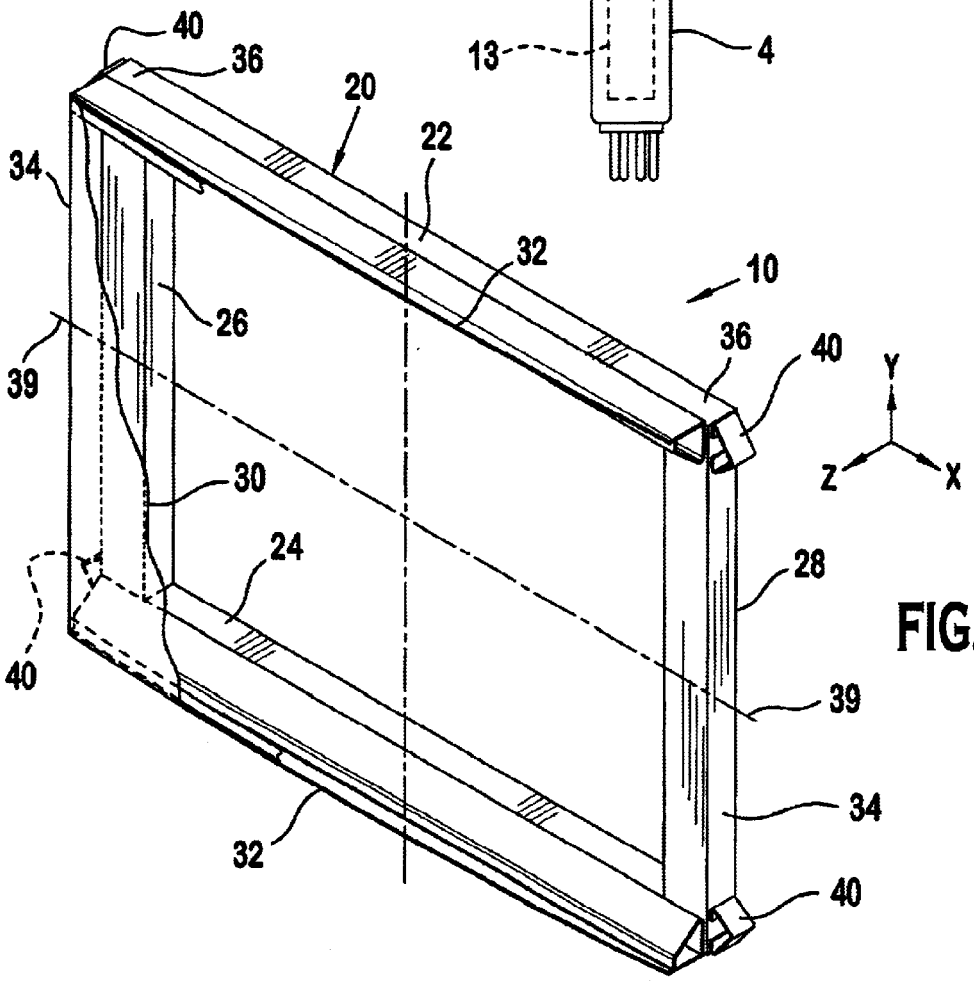
FIG. 2 is a perspective view of brackets attached to a mask-frame assembly.

The mask-frame assembly 10, as shown in FIGS. 1 and 2, has a generally rectangular support frame 20 to which a peripheral portion of a shadow mask 30 is attached. The frame 20 includes two long sides 22, 24, and two short sides 26, 28. The two long sides 22, 24 of the frame 20 are parallel to a central major axis, X, of the CRT 1. The two short sides 26, 28 are parallel to a central minor axis, Y, of the CRT 1. The two long sides 22, 24 and two short sides 26, 28 form a continuous mask support frame 20 in which the long sides 22, 24 lie in a common plane generally parallel to the tension mask 30. The major and minor axes are perpendicular to the central longitudinal axis Z of the tube which passes through the center of the neck and the center of the panel.

The shadow mask 30 shown here diagrammatically as a sheet for simplicity is a tension mask having a plurality of metal strips (not shown) with a multiplicity of elongated slits (not shown) therebetween that parallel the minor axis, Y, of the CRT 1. The mask 30 is preferably fixed to a pair of support blade members 32, which are fastened to the frame 20. The support blade members 32 may vary in height from the center of each support blade member 32 longitudinally to the ends of the support blade member 32 to permit the best curvature and tension compliance over the tension mask 30.

Figure 3:
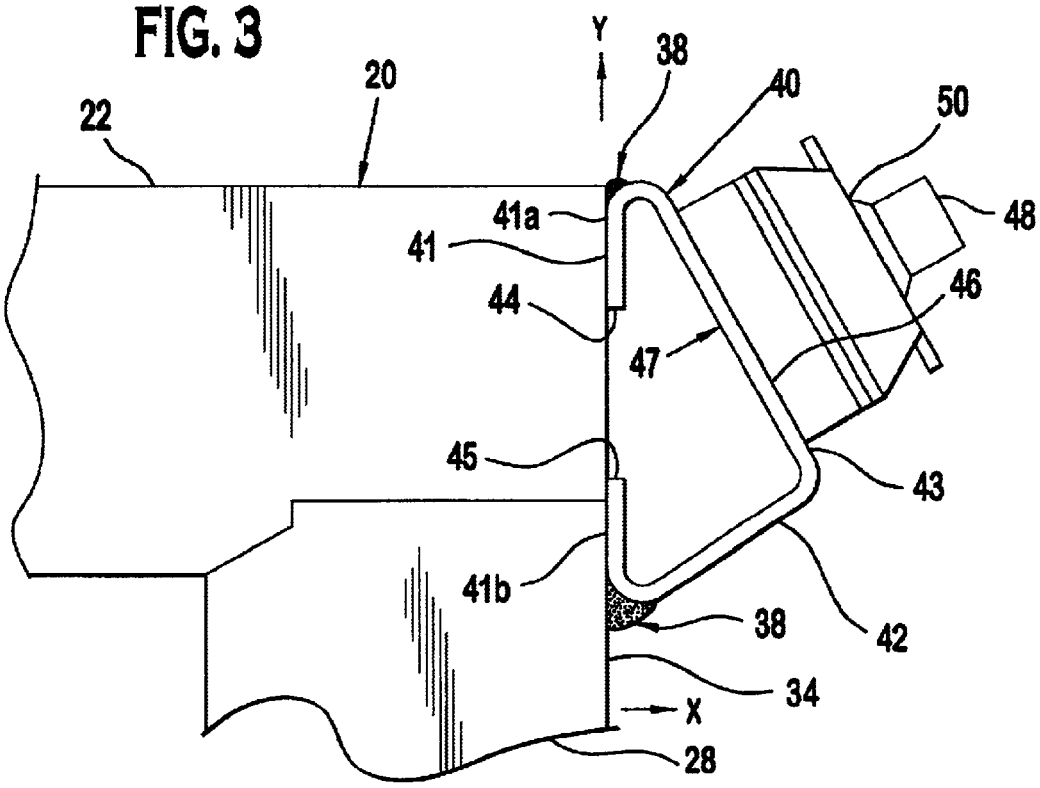
FIG. 3 is a detailed view of one of the brackets shown in FIG. 2 that is attached to a spring-clip assembly.

The mask-frame assembly 10 is removably mounted in predetermined spaced relation to the screen 12. To attach the mask-frame assembly 10 to the faceplate 3, brackets 40, shown in FIGS. 2 and 3, are attached to an exterior surface 34 along the short side 28 of the frame 20. As shown in FIG. 3, each bracket has three sections, first section 41, second section 42, and a flat surface section 43. Flat surface section 43 includes an inner surface 47 and an outer surface 46. The first section 41 consists of a first portion 41*a* and a second portion 41*b*. The first portion 41*a* has a first end 44 that faces a second end 45 of the second portion 41*b*. The outer surface 46 of the flat surface section 43 acts as a clip-welding surface for attachment of a spring-clip assembly 50. The flat surface section 43 is positioned to be approximately orthogonal to the substantially planar second section 42. The second section 42 is attached to the first section 41, such that the second portion 41*b* of the first section 41 is coplanar with the first portion 41*a*. A gap is located between the first end 44 and the second end 45 on the first section 41. The first portion 41*a* and the second portion 41*b* have approximately the same length.

Figure 4:
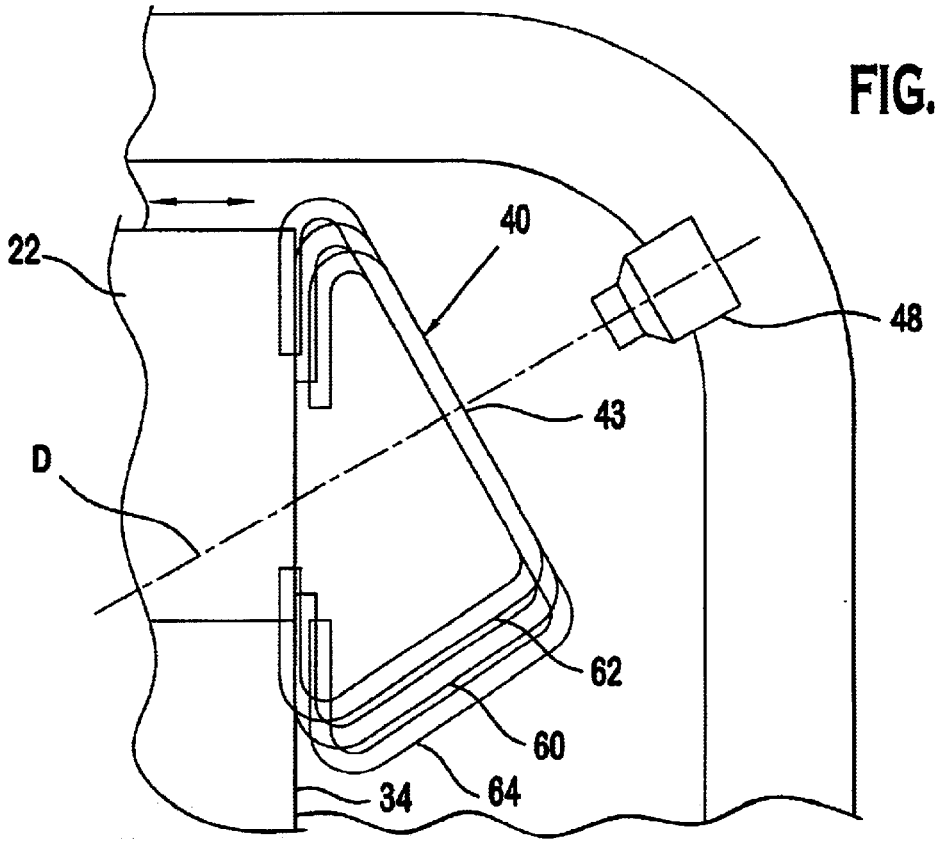
FIG. 4 is a detailed view of the bracket shown in FIG. 3 being positioned for attachment to the mask-frame assembly.

As illustrated in FIG. 3, the three sections 41, 42 and 43 of the bracket define a substantially triangular structure with the proper angles to ensure that the flat surface section 43 is oriented substantially normal to the diagonal axes of the panel 3 along which the studs 48 are affixed to the panel, as shown in FIGS. 3 and 4. The line D, as shown in FIG. 4, indicates the true diagonal axis of the tube faceplate panel. A diagonal D extends through the centers of the studs at opposing corners of the panel and through the center of the panel. It should be understood, however, that other angular relationships between sections 41, 42, and 43 are within the spirit of the invention. For example, any acute angle could be selected between first section 41 and flat surface section 43 so that the resultant flat surface section 43 is substantially normal to the longitudinal axis of the studs affixed to the panel. The angle between the first section 41 and the flat surface section 43 may be selected so that the spring-clip assembly mounted on the flat surface section 43 is angularly oriented to properly attach to studs affixed to the faceplate panel 3 as will be described below.

As shown in FIG. 3, the spring-clip assembly 50 comprises a substantially flat surface for attachment to flat surface section 43 of the bracket 40. The spring-clip assembly 50 has mounting features, such as an aperture for receipt of a stud 48 for mounting the frame 20 to the inside of the faceplate panel 3 of the CRT 1. It should be understood by those skilled in the art, however, that although the spring-clip assembly 50 is preferably attached to the outer surface 46 of flat surface section 43, the inner surface 47 could also be used for attachment because either surface is accessible due to the open triangular cross-sectional shape of the bracket 40.

The attachment process for attaching the bracket 40 to the frame 20 will now be described in greater detail with reference to FIG. 4. It should be understood that while a single attachment will be described here, the attachment of the additional brackets 40 around the frame 20 is performed in substantially the same way. To attach the bracket 40 to the frame 20, the first and second portions 41*a*, 41*b* of the first section 41 are positioned adjacent to the exterior surface 34 of the short side 28. The bracket 40 is positioned along the exterior surface 34 near the corners of the short side 28 until the flat surface section 43 is aligned as mentioned above with the stud 48 affixed to the faceplate panel 3 of the CRT 1. Because the bracket 40 can be translated along the short side of the frame 20, the bracket 40 can accommodate frames of various widths as shown in FIG. 4. The illustration in FIG. 4 shows that the bracket 40 is at a first position 60 for a frame 20 having an intermediate width, while the bracket 40 is set at a second position 62 for a frame with a smaller width and the bracket 40 is set at a third position 64 for a frame 20 with a larger width. The width of the flat surface section 43 of the bracket 40 is preferably made large enough to accommodate the range of frame width variation anticipated by the manufacturing process. When the flat surface section 43 is at the proper distance relative to the stud 48 to ensure proper attachment of a spring-clip assembly 50, the bracket 40 is welded in place. The weld sections 38 are positioned adjacent to the first and second portions 41*a*, 41*b* on the first section 41 of the bracket 40.

Advantageously, the bracket 40 is designed to be moved along a side of the frame 20 to achieve proper alignment between the spring-clip assembly 50 and the stud 48 affixed to the faceplate panel 3.

The invention also provides a way for attaching the bracket 40 to mask frames which do not have top or bottom surfaces capable of accommodating brackets 40. For such frames, the tube manufacturer can affix the bracket to the peripheral or exterior surface 34 of the mask frame.

What is claimed is:

1. A cathode ray tube including an evacuated envelope having a substantially rectangular faceplate panel with two diagonal axes that extend between opposing corners of the panel, that comprises a shadow mask-frame assembly having a frame with two opposing long sides and two opposing short sides forming a continuous mask support frame, the mask-frame assembly is mounted within the tube by brackets located near the corners of the frame and being adjustably secured to the short sides of the frame, the brackets include a flat surface section extending normal to the diagonal axes of the panel for securing a spring clip assembly for engaging a stud affixed to the panel.

2. The cathode ray tube of claim 1, wherein the studs comprise a longitudinal axis, the longitudinal axis of the studs being substantially parallel to the diagonal axes of the panel.

3. The cathode ray tube of claim 1, wherein the spring-clip assembly is welded to the flat surface section of the brackets.

4. The cathode ray tube of claim 1, wherein each of the brackets is non-continuous and has a first portion and a second portion of substantially equal length.

5. A cathode ray tube including an evacuated envelope having a substantially rectangular faceplate panel, the panel including two diagonal axes extending between opposing corners of the panel, the panel including a substantially rectangular shadow mask frame with two opposed long sides paralleling the major axis of the tube and two opposed short sides paralleling the minor axis of the tube, the frame includes brackets secured along the short sides of the frame for supporting the frame in the panel, each of the brackets comprising a flat surface section and a first and second section extending from both ends of the flat surface section, the first section being secured to the short sides near the corresponding corner of the frame, the first section, second section and flat surface section defining a triangular structure wherein the flat surface section extends normal to the diagonal axes of the panel.

6. The cathode ray tube of claim 5, wherein the first section of the bracket is non-continuous and has a first portion and a second portion of substantially equal length.

7. The cathode ray tube of claim 5, wherein the bracket further comprises a spring-clip assembly secured to the flat surface section for engaging a stud affixed in each corresponding corner of the panel.

8. The cathode ray tube of claim 7, wherein the stud comprises a longitudinal axis, the stud axis being substantially parallel to the respective diagonal axis of the panel.

* * * * *